US009534484B2

(12) United States Patent
Wright et al.

(10) Patent No.: US 9,534,484 B2
(45) Date of Patent: Jan. 3, 2017

(54) FRACTURING SEQUENTIAL OPERATION METHOD USING SIGNAL RESPONSIVE PORTED SUBS AND PACKERS

(71) Applicant: Baker Hughes Incorporated, Houston, TX (US)

(72) Inventors: Beau R. Wright, Tomball, TX (US); Edward T. Wood, Kingwood, TX (US)

(73) Assignee: Baker Hughes Incorporated, Houston, TX (US)

( * ) Notice: Subject to any disclaimer, the term of this patent is extended or adjusted under 35 U.S.C. 154(b) by 355 days.

(21) Appl. No.: 14/080,544

(22) Filed: Nov. 14, 2013

(65) Prior Publication Data

US 2015/0129218 A1 May 14, 2015

(51) Int. Cl.

| | |
|---|---|
| ***E21B 34/14*** | (2006.01) |
| ***E21B 43/26*** | (2006.01) |
| ***E21B 43/263*** | (2006.01) |
| ***E21B 43/14*** | (2006.01) |

(52) U.S. Cl.
CPC ..... *E21B 43/263* (2013.01); *E21B 34/14* (2013.01); *E21B 43/14* (2013.01)

(58) Field of Classification Search
CPC ..... E21B 43/263; E21B 43/14; E21B 23/08; E21B 23/10; E21B 2034/007; E21B 34/14
See application file for complete search history.

(56) References Cited

U.S. PATENT DOCUMENTS 3,570,594 A 3/1971 Hamilton
3,896,667 A 7/1975 Jeter
6,035,880 A 3/2000 Gazda
6,257,338 B1 * 7/2001 Kilgore ..... E21B 33/1246 166/187
6,394,184 B2 * 5/2002 Tolman ..... E21B 17/203 166/120
6,470,970 B1 10/2002 Purkis et al.
(Continued)

FOREIGN PATENT DOCUMENTS

EP 1225302 7/2002
WO 2009105128 A1 8/2009

OTHER PUBLICATIONS

McCoy, J.N., et al., "Timer Control of Beam Pump Run Time Reduces Operating Expense", Presented at the Forty-Sixth Annual Southwestern Petroleum Short Course in Lubbock, Texas, Apr. 21-22, 1999, 16 pages.

*Primary Examiner* — Brad Harcourt
(74) *Attorney, Agent, or Firm* — Steve Rosenblatt

(57) ABSTRACT

The method allows a pressure test of a string with external packers without having the packer setting apparatus exposed to tubing pressure so that at a later time and at a lower pressure than the pressure test pressure, the external packers can be set with annulus pressure opened to a piston that references a low pressure chamber. The packers can be set in any desired order. Thereafter, a circulation sub can be triggered to open to allow the fracking to start. Fracking each interval beyond the first in an uphole direction can be accomplished with pumping ever increasing balls to seats associated with sliding sleeves to open the sleeves in order. In cemented completions, after a pressure test, a ported sub can open on a timer or other signal to allow pumping a combination of a bridge plug and a perforating gun to the desired location.

15 Claims, 5 Drawing Sheets

(56) References Cited

U.S. PATENT DOCUMENTS

| | | | | |
|---|---|---|---|---|
| 2001/0018977 | A1 | 9/2001 | Kilgore | |
| 2004/0045724 | A1 | 3/2004 | Buyers et al. | |
| 2009/0071642 | A1 | 3/2009 | Moyes | |
| 2010/0200243 | A1 | 8/2010 | Purkis | |
| 2011/0240311 | A1* | 10/2011 | Robison | E21B 23/04 166/373 |
| 2012/0006562 | A1 | 1/2012 | Speer et al. | |
| 2012/0085538 | A1* | 4/2012 | Guerrero | E21B 33/12 166/284 |
| 2012/0138311 | A1 | 6/2012 | Stout | |
| 2012/0160524 | A1* | 6/2012 | Lumbye | E21B 33/1243 166/387 |
| 2013/0014953 | A1* | 1/2013 | van Petegem | E21B 34/14 166/308.2 |
| 2013/0062124 | A1 | 3/2013 | Roders et al. | |
| 2013/0146291 | A1 | 6/2013 | O'Malley | |
| 2013/0206425 | A1 | 8/2013 | Mazyar | |
| 2014/0034319 | A1* | 2/2014 | Surjaatmadja | E21B 43/14 166/305.1 |
| 2014/0131035 | A1* | 5/2014 | Entchev | E21B 43/263 166/255.1 |

* cited by examiner

FRACTURING SEQUENTIAL OPERATION METHOD USING SIGNAL RESPONSIVE PORTED SUBS AND PACKERS

FIELD OF THE INVENTION

The field of this invention is fracking in completions where the liner needs to have a pressure integrity test or internal pressure applied and objects need to be pumped to a desired location through a flow path established after the pressure application.

BACKGROUND OF THE INVENTION

As regulations regarding completions become more restrictive due to safety and other reasons a need has arisen to perform a pressure integrity test on a string in a variety of circumstances. The string could be cemented and need to have a series of bridge plugs and perforating guns delivered at different depths so that portions can be sequentially perforated and fracked. However, with a need for a pressure test on the tubular there needs to be no openings in the wall open. In order to then be able to pump bridge plugs attached to perforating guns after a pressure test particularly in a horizontal well defined as having an incline of more than 62 degrees from vertical there has to be a wall opening through which circulation or injection can be established where the ported sub that can provide such an opening is configured to stay closed during the pressure test of the string. The problem is that if the ported sub opens in response to applied internal pressure, the needed pressure to get the ported sub to open after the pressure test of the tubular will require subjecting the string to even higher pressures to open. In other fracking systems a series of packers that are spaced apart are set at the same time before any fracking sleeves are opened up. The problem here is that if a pressure test is required on the string and the packer setting ports are still open then the packers will be subjected to higher pressures than the intended setting pressure. This additional setting force on the packers can adversely affect the formation by fracturing at the packers rather than as intended between them. Accordingly it would be advantageous to be able to pressure test the string without the packers set and then set the packers without having to further resort to even higher pressures than the pressure integrity test on the tubular string.

The method of the present invention relies on ported subs that can be selectively opened with a timer or a signal. In the case of multiple spaced packers, the string can be pressure tested without the packers being set. The setting force for setting the packers can be annulus pressure so that valves can communicate annulus pressure to an actuation piston for the packers to set them with a reference pressure on the opposite side of the piston as being low or atmospheric. The order of setting can be as desired and the valves can respond to a timer or another signal for operation to set the packers in the desired order. Then in order to be able to deliver a succession of balls to different frack sleeves between pairs of packers a ported sleeve valve can be triggered by timers or other signal to open a first access to the formation so that all balls that then need to land on seats and shift sleeves for formation access can be pumped because there will always be a flow path for fluid to carry each ball to its destination.

Relevant to the art of using timers to shift sleeves or operate other downhole equipment are: WO2009/105128A1; U.S. Pat. Nos. 4,709,708; 6,035,880; 3,896,667; 3,570,594; U.S. 20130062124; 20120138311; 20100200243; 20090071642; 20040045724. Also of interest is J. N. McCoy Timer Control of Beam Pump Run Time Reduces Operating Expense presented at the 46$^{th}$ Annual Southwestern Petroleum Short Course, Lubbock, Tex. Apr. 21-22, 1999.

Those skilled in the art will better understand the methods of the present invention from a review of the description of the preferred embodiment and the associated drawings while recognizing that the full scope of the invention is to be determined from the appended claims.

SUMMARY OF THE INVENTION

The method allows a pressure application in a string with external packers without having the packer setting apparatus exposed to tubing pressure so that at a later time and at a lower pressure than the pressure test pressure, the external packers can be set with annulus pressure opened to a piston that references a low pressure chamber. The packers can be set in any desired order. Thereafter, a port sub can be triggered to open to allow the fracking to start. Fracking each interval beyond the first in an uphole direction can be accomplished with pumping ever increasing balls to seats associated with sliding sleeves to open the sleeves in order. In cemented completions, after a pressure test, a ported sub can open on a timer or other signal to allow pumping a combination of a bridge plug and a perforating gun to the desired location.

DETAILED DESCRIPTION OF THE PREFERRED EMBODIMENT

Figure 1:
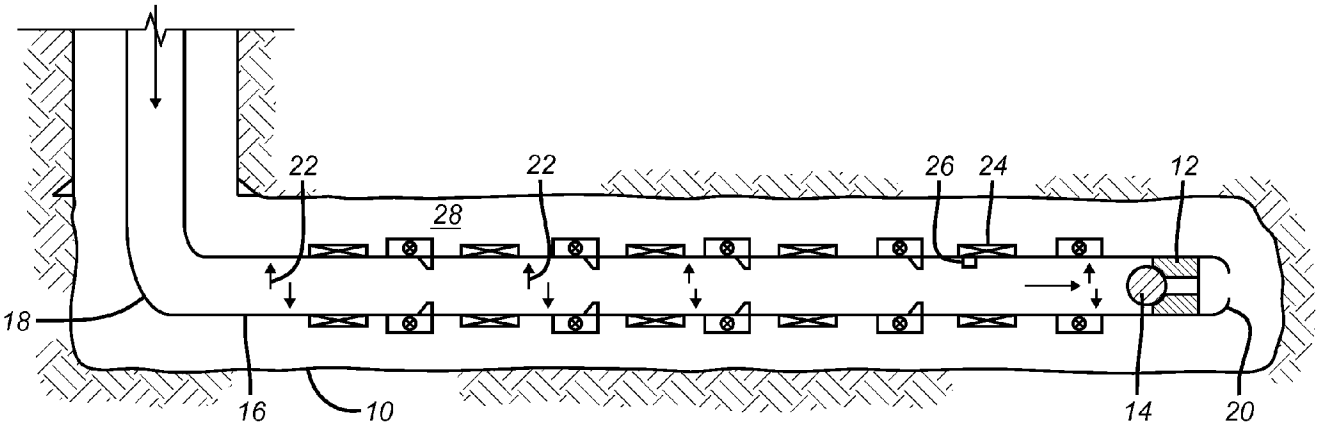
FIG. 1 shows a pressure application or test in the string with multiple external packers being unset.
Figure 2:
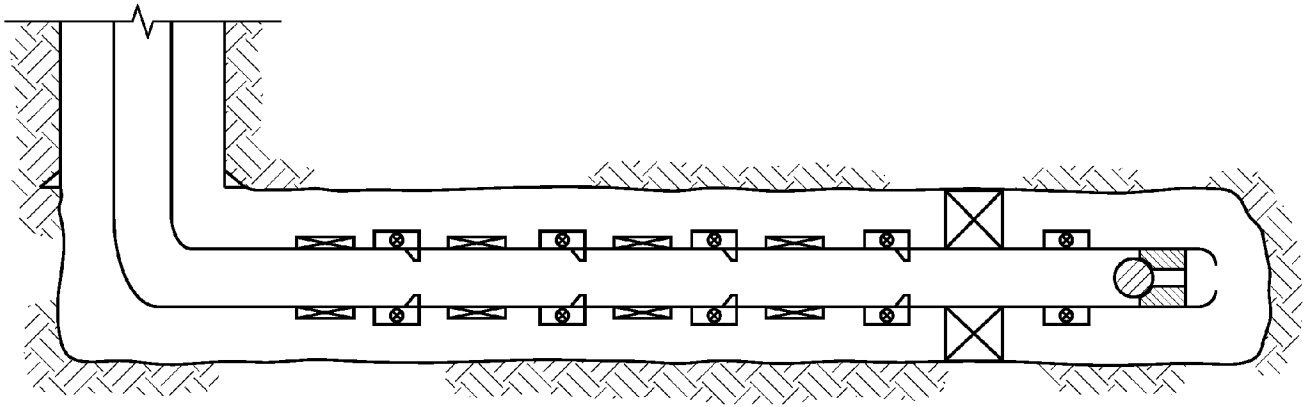
FIG. 2 is the view of FIG. 1 of the first packer in FIG. 1 being set with a lower pressure than the pressure test pressure of FIG. 1.

FIG. 1 shows a horizontal borehole 10 having a ball seat 12 on which has landed a ball 14 to allow pressuring up the string 16 that extends from a surface location and past a heel 18 to a toe 20. Arrows 22 represent internal pressure being applied to pressure test the string 16 usually to a pressure level of about 80% of its working pressure. External packers 24 can be configured to set with tubing pressure or annulus pressure. The access to the setting piston for each packer is sealed off with valves such as schematically illustrated valves 26 that are in the string 16 but can also be on the side of the annulus 28. These valves are each closed during the pressure test of the string 16. Thus the pressure test is completed without the packers 24 set and with the setting mechanisms for packer setting isolated from tubing or annulus pressure. After the pressure test is successfully completed the valves 26 associated with each packer 24 can be actuated with a time or with a delivered signal that can arrive with a pumped ball or acoustically or electrically or with pressure pulse patterns or a pressure cycling pattern, an acoustic signal, an electric or magnetic field among other alternatives. With the signals received access to the setting piston or other actuator for each of the packers 24 can be set in the desired sequence. The packers 24 can be hydrostatically set in a known manner by opening a port to hydrostatic pressure on one side of a piston with the opposite side of the piston referencing a variable volume low pressure chamber. In this manner the packers 24 can be set in any desired order depending on timer settings or sequencing of signals. If the valves 26 are in the string 16 then the packer setting mechanism is isolated from tubing pressure during the pressure test so that at a later time when the test pressure is released, the valves 26 can be opened in the desired order and far lower pressures can be used to set the packers than the applied test pressure to test the string. If the valves are in the annulus then they are unaffected by the test pressure on the tubular and again the packers 24 can be opened in any desired order by signaling the valves 26 with timers or through transmitted signals.

Figure 3:
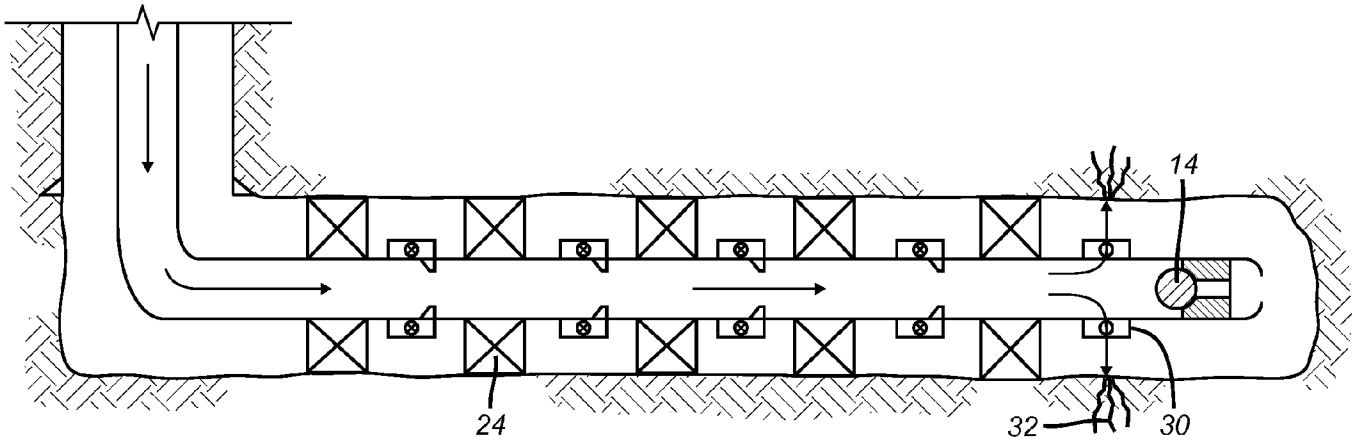
FIG. 3 shows a port being opened with a timer or other signal so that the fracking can start.
Figure 4:
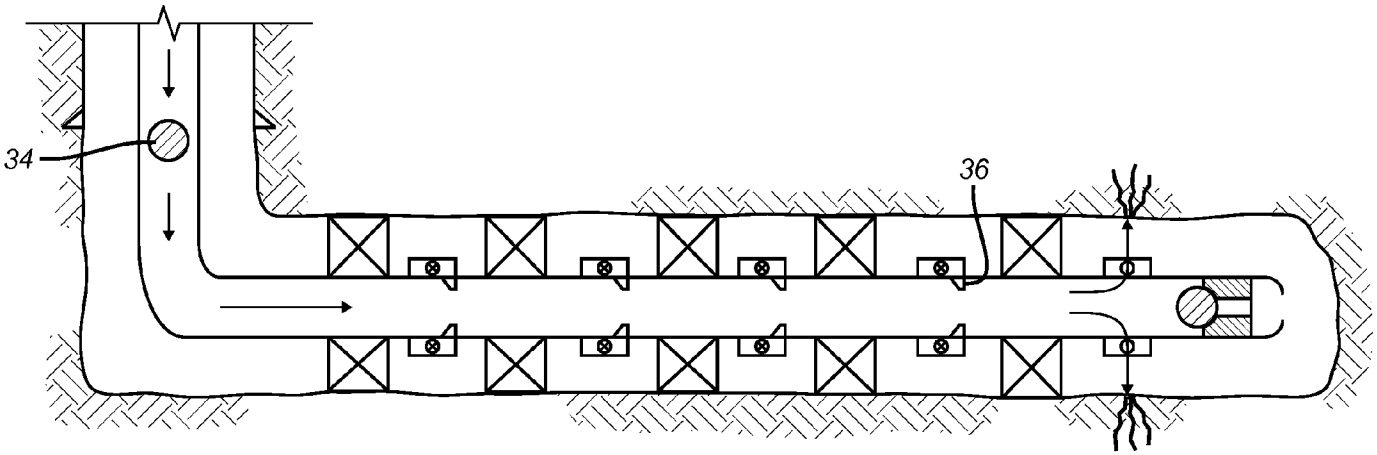
FIG. 4 is the view of FIG. 3 showing how the various landing seats can have a ball pumped to them because of the initially opened port.
Figure 5:
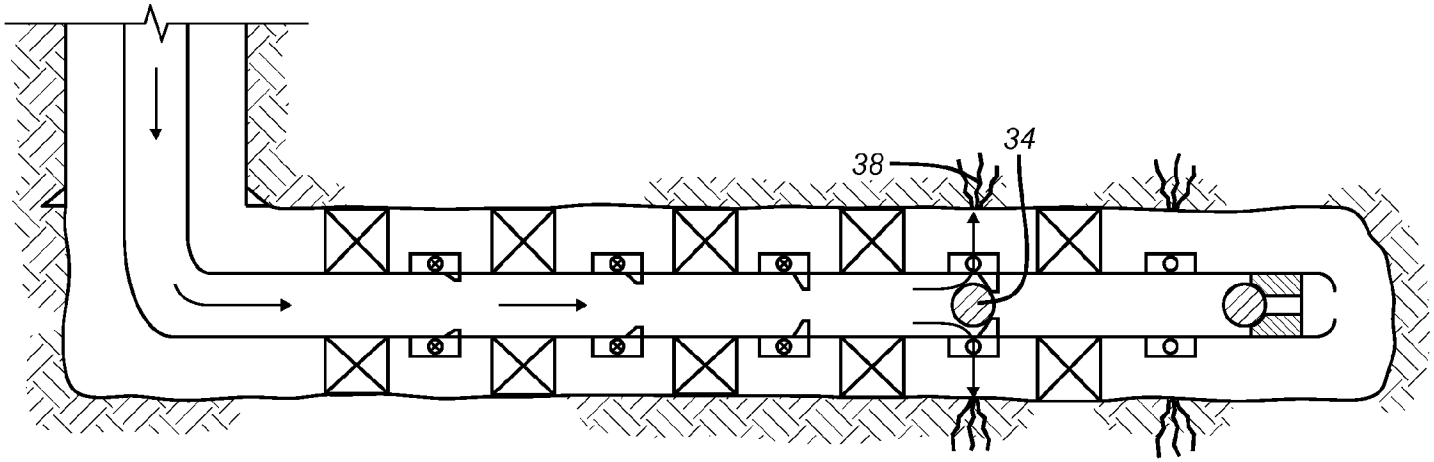
FIG. 5 is the view of FIG. 4 with a first ball pumped to a landing location to initiate fracking in the next zone.
Figure 6:
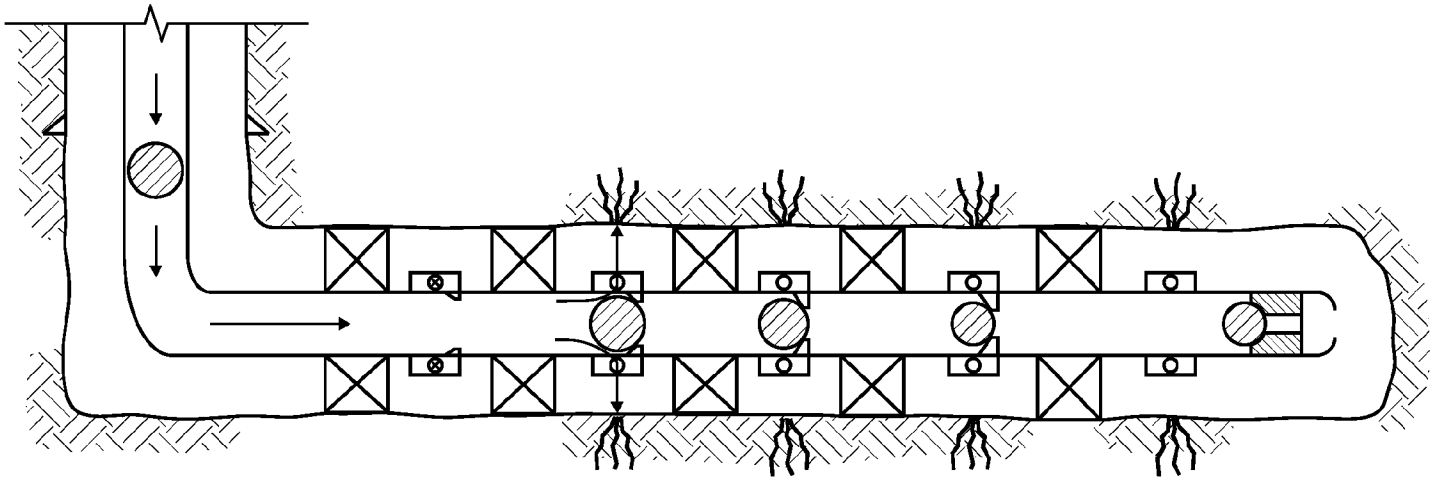
FIG. 6 is the view of FIG. 5 showing the remaining balls landed so that the fracking in the other intervals can be completed.

In FIG. 3 the packers 24 are all set and another ported sub 30 is schematically illustrated as opening to provide access to a first interval for fracking to produce fractures 32 in an interval above ball 14. Once the fractures 32 are made it opens a way to pump down subsequent balls due to the fact that there is always a way to pump fluid to deliver a ball such as 34 to the next seat 36 on which ball 34 is needed to land. Once that happens fractures 38 can be initiated in the next interval by pressure delivered on seated ball 34. FIGS. 5 and 6 show the process being repeated with progressively larger balls with there always being a way to pump them into position in a horizontal well where the deviation from vertical is defined as at least 62 degrees.

The method described above addresses two potential problems when the string requires a pressure test. First, the packers are not set first before the pressure test on the string. Instead, the pressure test is run with the packers unset and their setting mechanism shielded from string test pressures or annulus pressure. Furthermore, with the packers unset the risk of creating fractures at set packer locations is removed as can happen when the higher test pressure for the string is allowed to act on the setting pistons of the already set packers to further set them to enough of a degree where they can actually initiate or greatly extend fractures in undesirable locations. The ideal situation is that the fractures initiate between the barriers rather than at the barriers. With the packers unset during the pressure test there is no risk of initial or additional fractures forming at the packer locations. When the packers are then ready to set after the pressure test, they can be set with tubing pressure that is at far lower pressures than the tubing test pressures previously used during the pressure test. If annulus pressure is to be used to set the packers then the same result obtains as the setting pressure in the annulus when the setting mechanism of the packers is exposed to such pressures is far lower than the tubing pressure during the pressure test. The setting ports are selectively made accessible to tubing or annulus pressure with timer or signal triggered valves as described above so that the packers can be set in any desired order. With the packers set another port is opened either by timer or signal to expose the lowest interval for fracking. This initial fracking of the lowermost zone allows there to be created a flow path that allows pumping of each of the progressively increasing in diameter subsequent balls to be pumped into a horizontal borehole to be quickly landed on a respective ball seat so that the intervals can be sequentially fractured in a bottom up order. This valve that operates on a timer or through a transmitted signal solves the problem of having ports closed during the pressure test and avoiding to run the pressure even higher than the pressure test pressure to get the ports to open after the pressure test ends. Instead, the circulation sub is triggered to open with time or with a transmitted or other signal so that the initial opening solves the problem of how to pump the sequential array of balls to a horizontal formation for the fracking of the zone from bottom up where there is also a need for a pressure integrity test before the fracking starts. Overpressures of the string as would occur with a pressure actuated circulation sub that had to open only after a pressure test of the string are avoided.

Figure 7:
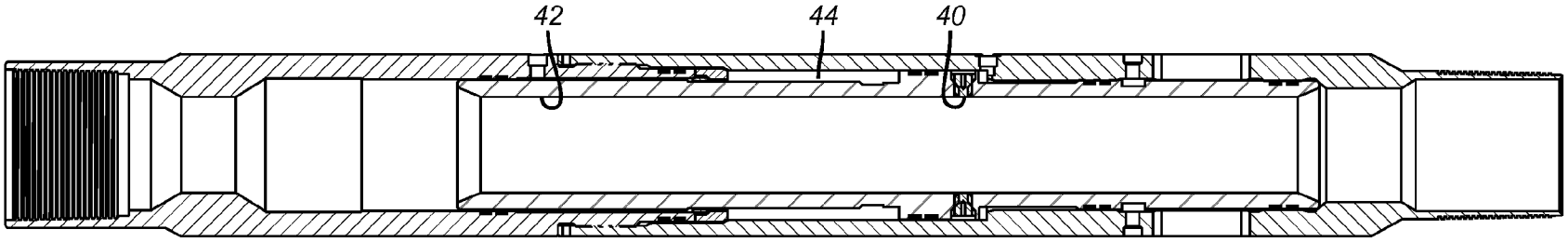
FIG. 7 shows one design of a ported sleeve sub that can be triggered with a timer or a signal in the run in position where the ports are closed.
Figure 8:
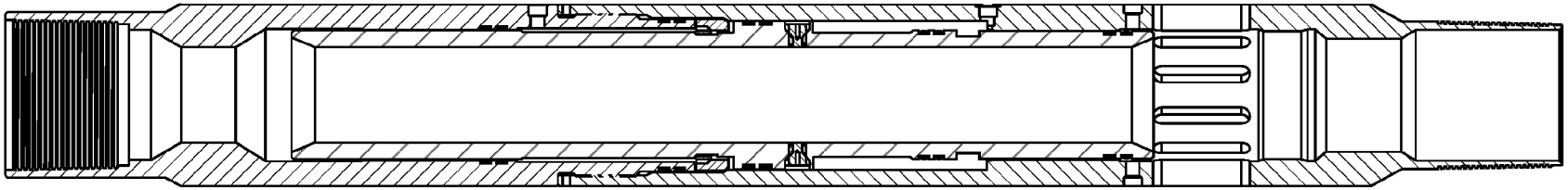
FIG. 8 is the view of FIG. 7 in the open position.
Figure 9:
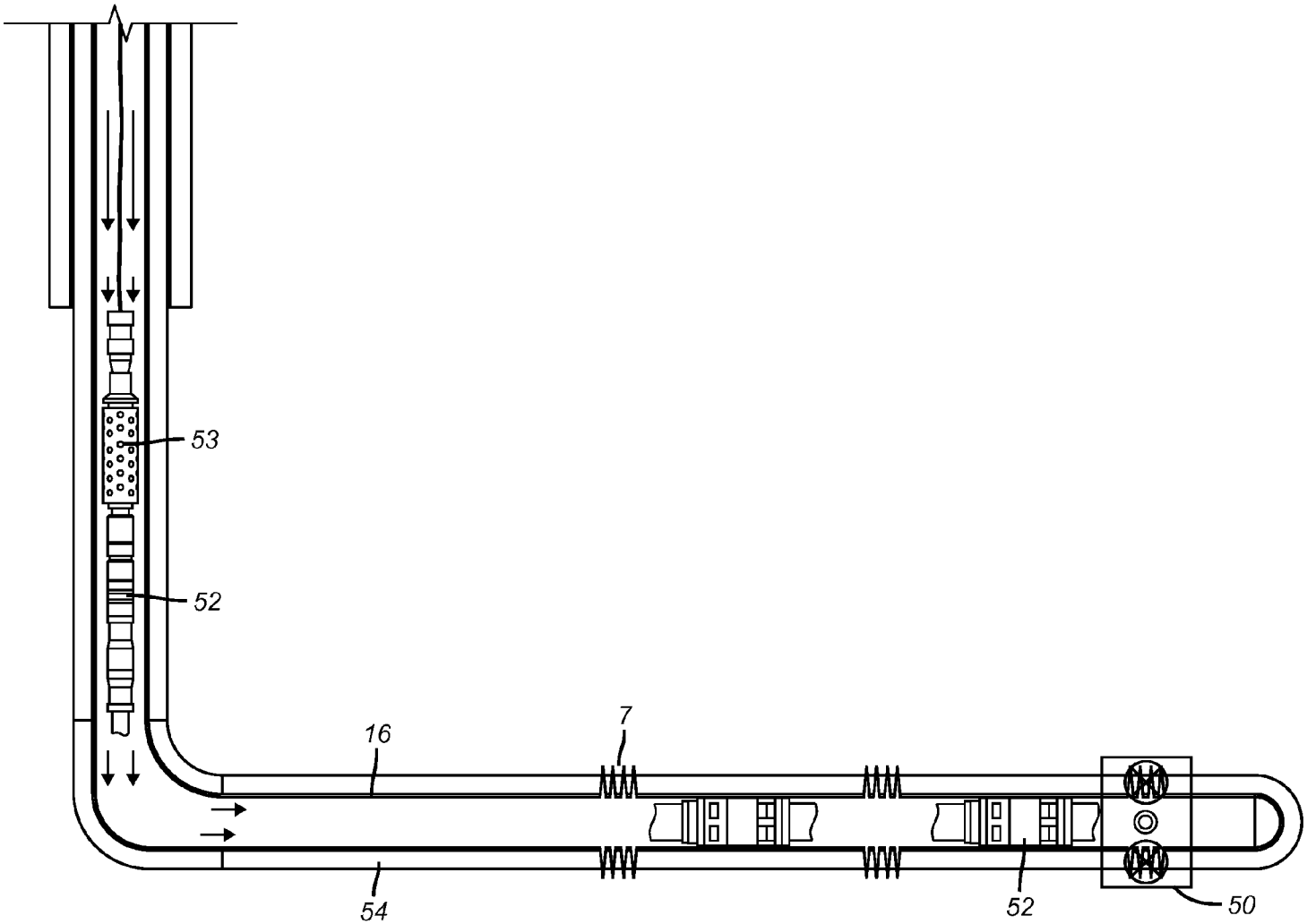
FIG. 9 is the view of FIGS. 7 and 8 showing an application of such a valve to open a wall port to allow pumping a bridge plug and perforating gun combination with circulation.

FIGS. 7 and 8 illustrate a known design for a ported sub that acts with pressure at an inlet 40 that can be opened with pressure acting on a rupture disc blocking the opening so that the piston 42 is stroked against a low pressure or atmospheric chamber 44. Even if there is cement in the annulus, the opening of ports 46 allows access to the formation for pumping down into a horizontal bore equipment such as a bridge plug with an attached perforating gun 53. This is illustrated in FIG. 9 where a circulation valve or port 50 is blocked with an assembly that responds to a timer or another signal to open at a time after a string pressure test so that stages of bridge plugs 52 and perforating guns 53 can be pumped into the wellbore with displaced fluid having a path into the formation after penetrating the cement in the surrounding annulus that may or may not have set up by that time. As each gun is fired in its interval the access that was cut off to the formation fracked below the just set bridge plug is opened again with the firing of the gun above the just set bridge plug. In this sense the pressure test can take place first followed by opening a port with a timer or other signal that allows the first assembly of bridge plug and perforating gun to be pumped into position. Thereafter it is just each newly made perforation 7 that enables pumping down the next assembly into a horizontal run in a borehole.

The above description is illustrative of the preferred embodiment and many modifications may be made by those skilled in the art without departing from the invention whose scope is to be determined from the literal and equivalent scope of the claims below:

We claim:

1. A completion method, comprising:

running in a string into a borehole having an open passage therethrough when running in;

closing off said passage through said string after said running in with an object delivered into said open passage to a seat;

blocking off at least one wall access port;

applying pressure to said string with said wall access port closed at a first pressure for a pressure test of said string;

isolating an actuator for said at least one packer from said first pressure during said pressure test of said string;

setting at least one packer associated with said at least one wall port to isolate an annular space around said string after said applying said first pressure and before opening said at least one wall port, said packer being set using a second pressure lower than said first pressure;

accomplishing said setting of said at least one packer by opening access to an actuator for said packer after said first pressure application with a signal other than sustained pressure in said string such that said at least one packer can be actuated with said second pressure;

opening said at least one wall port so that pressure delivered against said object on said seat is directed through said at least one wall port.

2. The method of claim 1, comprising:

setting said packer into an open surrounding annular space above and below said packer with a signal responsive device that selectively provides access to a setting mechanism associated with said at least one external packer.

3. The method of claim 2, comprising:

setting said packer with pressure in said string after providing a signal to said signal responsive device.

4. The method of claim 2, comprising:

setting said packer with pressure in a surrounding annulus about said string after providing a signal to said signal responsive device.

5. The method of claim 2, comprising:

using said open wall access port for initial fracturing below said packer after said packer is set.

6. The method of claim 1, comprising:

using a timer for said signal.

7. The method of claim 1, comprising:

delivering an object near said actuator for said packer for said opening access.

8. The method of claim 1, comprising:

using at least one of a pressure cycling pattern, an acoustic signal, an electric or magnetic field as said signal.

9. The method of claim 1, comprising:

delivering a bridge plug and a perforating gun by pumping with flow going into said opened wall access port.

10. The method of claim 9, comprising:

setting said bridge plug to close off said wall access port;

releasing said gun from said plug and repositioning said gun uphole;

firing said gun to provide a new access location through the wall of said string;

delivering another bridge plug and perforating gun by pumping to said new access location.

11. The method of claim 9, comprising:

fracking through said wall access port before said delivering.

12. The method of claim 9, comprising:

using a timer for said signal.

13. The method of claim 9, comprising:

delivering an object near said actuator for said packer for said opening access.

14. The method of claim 9, comprising:

using at least one of a pressure cycling pattern, an acoustic signal, an electric or magnetic field as said signal.

15. A completion method, comprising:

running in a string into a borehole;

closing off passage through said string;

blocking off at least one wall access port;

setting at least one packer associated with said at least one wall port to isolate an annular space around said string before opening said at least one wall port;

applying pressure to said string with said wall access port closed;

opening access to an actuator for said packer after said pressure application with a signal other than sustained pressure in said string;

flowing through said at least one open wall access port;

setting said packer into an open surrounding annular space above and below said packer with a signal responsive device that selectively provides access to a setting mechanism associated with said at least one external packer;

using said open wall access port for initial fracturing below said packer after said packer is set:

providing a plurality of said at least one packer in a spaced relation to each other with each packer having an associated ball seat attached to a sliding sleeve;

using said open wall access to allow pumping of a ball to said associated ball seat closest to said open wall access port with fluid going through said wall access port as said ball lands on said closest seat and opens another wall access port uphole while isolating said wall access port that was initially opened.

* * * * *